US005243354A

United States Patent [19]

Stern et al.

[11] Patent Number: 5,243,354

[45] Date of Patent: Sep. 7, 1993

[54] MICROSTRIP ELECTRONIC SCAN ANTENNA ARRAY

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 935,931

[22] Filed: Aug. 27, 1992

[51] Int. Cl.[5] ..... H01Q 1/36

[52] U.S. Cl. ..... 343/700 MS; 343/754; 343/853; 333/1.1

[58] Field of Search ..... 343/700 MS, 754, 853, 343/846; 333/1.1, 24.2

[56] References Cited

U.S. PATENT DOCUMENTS

| | | | |
|---|---|---|---|
| 4,749,966 | 6/1988 | Stern et al. | 333/1.1 |
| 4,754,237 | 6/1988 | Stern et al. | 333/1.1 |
| 4,777,454 | 10/1988 | Stern et al. | 333/1.1 |
| 4,806,886 | 2/1989 | Stern et al. | 333/24.2 |
| 4,839,659 | 6/1989 | Stern et al. | 343/700 MS |
| 4,933,680 | 6/1990 | Shapiro et al. | 343/700 MS |
| 5,039,995 | 8/1991 | Hulbert | 333/1.1 |
| 5,144,320 | 9/1992 | Stern et al. | 343/700 MS |

OTHER PUBLICATIONS

Farzin Lalezari and Clifton David Massey, MM--WAVE Microstrip Antennas, Microwave Journal Apr. 1987, pp. 87, 88, 90,94, 96.

M. A. Weiss, Microstrip Antennas for Millimeter Waves, IEEE Transactions on Antennas and Propagation, vol. AP-29 No. 1, Jan. 1981, pp. 171-174.

*Primary Examiner*—Donald T. Hajec
*Assistant Examiner*—Tan Ho
*Attorney, Agent, or Firm*—Michael Zelenka; William H. Anderson

[57] ABSTRACT

A microstrip electronic scan antenna array is provided comprising a hollow elongated octagonal-shaped housing formed by four quadrantially-disposed microstrip patch antenna arrays and four filler panels extending between the patch arrays. Three, independently-switchable microstrip Y-junction circulators are tandem interconnected in a double-ended wye configuration on a common dielectric substrate forming an octagonal end cover for the housing. Each of the three circulators acts as a single pole-double throw switch and the sequence of energization of the four microstrip patch antenna arrays is determined by controlling the sequence and direction of circulator coupling action of the three circulators.

9 Claims, 3 Drawing Sheets

MICROSTRIP ELECTRONIC SCAN ANTENNA ARRAY

GOVERNMENT INTEREST

The invention described herein may be manufactured, used, and licensed by or for the Government for governmental purposes without the payment to us of any royalty thereon.

BACKGROUND OF THE INVENTION

I. Field of the Invention

This invention relates to electronic scan antennas operating in the millimeter and microwave regions of the frequency spectrum and, more particularly, to a microstrip electronic scan antenna array which is capable of producing 360 degree scanning in radar systems and the like.

II. Description of the Prior Art

Electronic scan antennas for radar systems and the like are often used in applications where the requirements of size, weight and operating reliability rule out the use of older mechanical scanning systems. Examples of such applications are military and commercial aircraft, terminal homing weapons and remotely piloted vehicles. Although electronic scanning has been provided by utilizing phase shifting techniques, systems using these techniques are usually complex in construction and costly to fabricate. The problems are exacerbated when a 360 degree scan is needed for applications, such as tank, terminal homing weapon and remotely piloted vehicle radar systems, for example, because the size, weight and cost of the resulting scanning systems needed for these applications exceed the size, weight and cost limitations imposed by the application. Furthermore, since much of the work in this area today is being carried out utilizing the microstrip transmission line medium of propagation, it is desirable to efficiently accomplish electronic scanning at millimeter wave frequencies utilizing scanning equipment and techniques suitable for use with the microstrip transmission line propagation medium.

SUMMARY OF THE INVENTION

It is an object of this invention to provide a microstrip electronic scan antenna array which may be fabricated relatively easily and inexpensively and which offers small size and weight.

It is a further object of this invention to provide a microstrip electronic scan antenna array which offers full 360 degree scanning capability at relatively low cost and with small size and weight.

It is a still further object of this invention to provide a microstrip electronic scan antenna array which is especially suited for use for radar applications for tanks, terminal homing weapons and remotely piloted vehicles.

It is another object of this invention to provide an electronic scan antenna array which is readily compatible for use with radar systems designed in the microstrip transmission line medium.

Briefly, the microstrip electronic scan antenna array of the invention comprises a plurality of microstrip patch antenna arrays disposed circumferentially about a central axis with each of the microstrip patch antenna arrays radiating a discreet antenna beam at a different selected bearing point about the axis when the array is coupled to a source of millimeter wave energy, and selectively operable microstrip circulator means coupled to the plurality of microstrip patch antenna arrays for sequentially coupling each of the plurality of microstrip patch antenna arrays to a source of millimeter wave energy. The selectively operable microstrip circulator means comprise a plurality of separately switchable microstrip Y-junction circulators tandem interconnected in double-ended wye configuration. Each of the circulators has an input and two outputs and operates as a single pole—double throw switch with respect to millimeter wave energy applied to the circulator input. When the plurality of microstrip patch antenna arrays comprises four microstrip patch antenna arrays, the plurality of switchable microstrip Y-junction circulators comprises three switchable microstrip Y-junction circulators tandem interconnected in a double-ended wye configuration with one of the three circulators having the input thereof coupled to the source of millimeter wave energy and the two outputs thereof coupled to the inputs of the remaining two of the three circulators. The remaining two circulators have the outputs thereof each coupled to a different one of the four microstrip patch antenna arrays. This arrangement provides full 360 degree scanning capability when the four microstrip patch antenna arrays are disposed at quadrantially related bearing points about the central axis and the four microstrip patch antenna arrays are successively coupled to the source of millimeter wave energy in the order of their bearing points about the axis.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
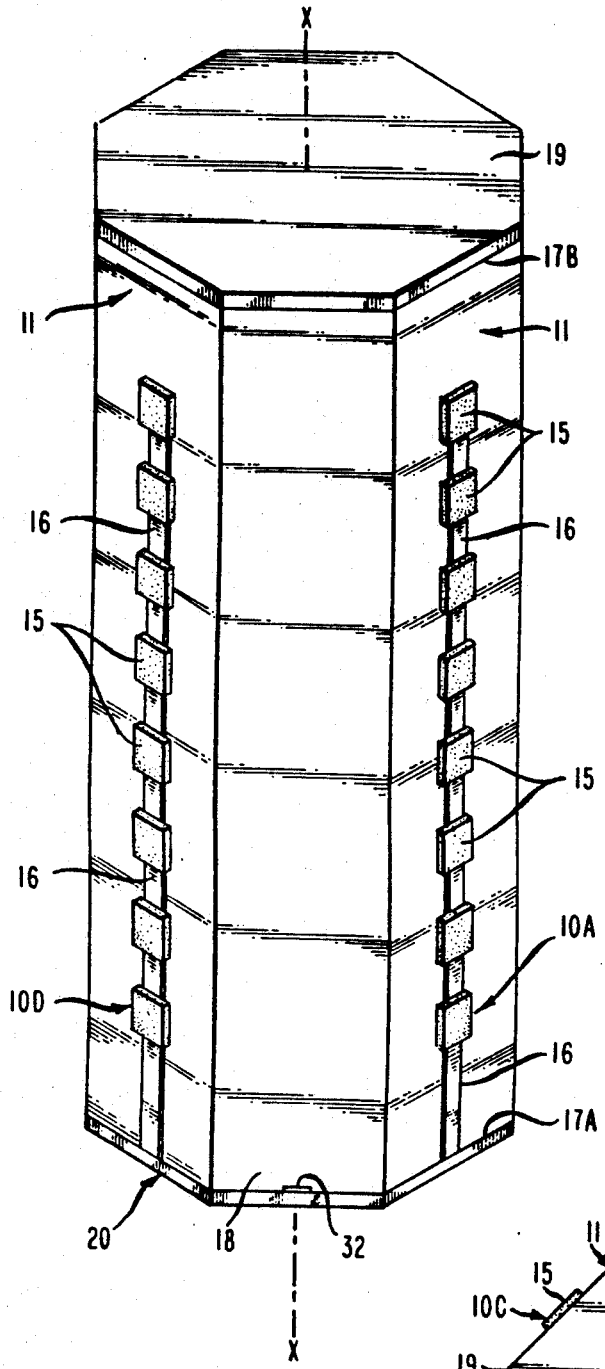
FIG. 1 is a perspective view of the microstrip electronic scan antenna array of the invention.
Figure 2:
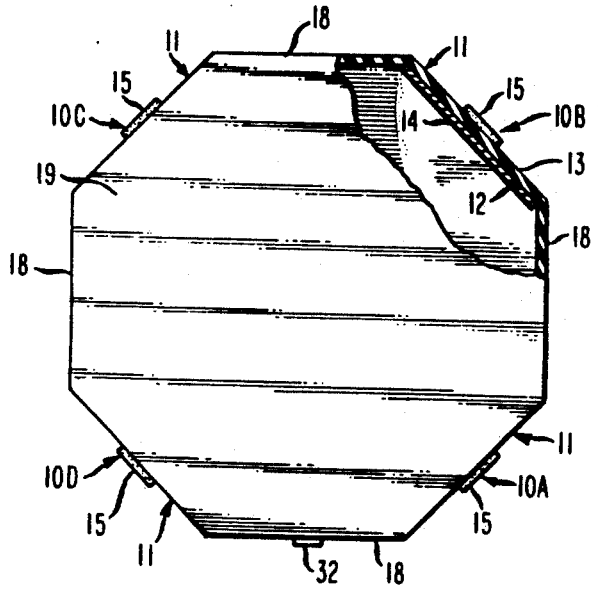
FIG. 2 is a top plan view of the electronic scan antenna array of FIG. 1 with a portion of the top cover of the housing broken away to reveal details of wall construction.

Referring now to FIGS. 1 and 2 of the drawings, there is shown a microstrip electronic scan antenna array constructed in accordance with the teachings of the present invention comprising four microstrip patch antenna arrays, indicated generally as 10A, 10B, 10C and 10D, which are disposed circumferentially about a central axis X—X. The four microstrip patch antenna arrays are of the same construction and each comprises a first microstrip transmission line dielectric substrate, indicated generally as 11, which is spaced laterally from and extends substantially parallel to the central axis X—X. The substrate 11 has an inner surface 12 facing the X—X axis and an outer surface 13 facing away from the axis. A first electrically conductive ground plane 14 is disposed on the inner surface 12 of the substrate 11 and a plurality of microstrip antenna radiating elements 15 are mounted on the outer surface 13 of the substrate. For reasons which will be explained hereinafter, the antenna radiating elements 15 may be mounted in a single column which is substantially parallel to the central axis X—X.

Each microstrip patch antenna array is completed by an electrically conductive microstrip conductor 16 which is mounted on the outer surface 13 of the first dielectric substrate 11 and which serves to interconnect the plurality of microstrip antenna radiating elements 15. It will be noted that the microstrip conductor means 16 extends down to one of the ends 17A of each of the four dielectric substrate panels 11 forming the four patch antenna arrays. In practice, the four dielectric substrates 11 may, for example, comprise a section of conventional microstrip dielectric substrate which is approximately 0.010 inch thick and which is fabricated of duroid or other similar dielectric material having a relatively low dielectric constant. The ground plane 14 and the microstrip conductors 16 should be fabricated of a good electrically conductive metal, such as copper or silver, for example. The microstrip radiating elements 15 may comprise conventional and well known microstrip patch radiators, dipoles or slots, for example.

The four microstrip patch antenna arrays 10A through 10D are disposed at quadrantially related bearing points about the central axis X—X, i.e., assuming microstrip patch antenna array 10A is at the 0 degree or 360 degree bearing or azimuth point about the X—X axis, antenna array 10B would be at the 90 degree bearing point, antenna array 10C would be at the 180 degree bearing point and array 10D would be at the 270 degree bearing point, so that the microstrip electronic scan antenna array has a 360 degree scanning capability when the four microstrip patch antenna arrays 10A through 10D are successively coupled to a source of millimeter wave energy in the order of their bearing points about the X—X axis, for example, 10A, then 10B, then 10C and then 10D.

The microstrip electronic scan antenna array further comprises four housing panels 18 which are each spaced laterally from and extend substantially parallel to the central axis X—X. Each of the housing panels 18 extends between a different adjacent pair of the first microstrip transmission line dielectric substrates 11 forming the four microstrip patch antenna arrays so that a hollow, elongated octagonal housing is formed about the central axis X—X. For example, the dielectric substrates 11 forming a part of patch arrays 10A and 10B would be an adjacent pair. An octagonal-shaped cover 19 is disposed substantially perpendicular to the central axis X—X and extends between the four housing panels 18 and the four dielectric substrates 11 at the other ends 17B of the dielectric substrates. In practice, the four housing panels 18 and the cover 19 may also be fabricated of a dielectric substrate material such as the aforementioned duroid, for example.

A second microstrip transmission line dielectric substrate, indicated generally as 20, extends perpendicular to the central axis X—X at the ends 17A of the first dielectric substrates 11 as seen in FIG. 1 of the drawings. The second dielectric substrate 20 is best described with reference to FIGS. 3 and 4 of the drawings wherein it is seen that the substrate 20 is octagonal-shaped and has one surface 21 upon which a second electrically conductive ground plane 22 is disposed. The other surface 23 of the substrate 20 faces the interior of the hollow, elongated octagonal housing and provides a site for mounting selectively operable microstrip circulator means which are used to sequentially couple each of the microstrip patch antenna arrays 10A through 10D to a source of millimeter wave energy. The second dielectric substrate 20 also serves as a cover member to close off the end 17A of the elongated housing and, like the first dielectric substrates 11, may be fabricated of duroid or other suitable dielectric material having a relatively low dielectric constant. Again, the second ground plane 22 should be fabricated of a good electrically conductive metal, such as copper or silver, for example.

Three wye-shaped ferrite elements, indicated generally as 24, 25 and 26, are mounted on the surface 23 of the second dielectric substrate 20. Although each of the three ferrite elements is integral in construction, each may be thought of as having a right-prism shaped central portion and three triangular shaped arm portions. Accordingly, ferrite element 24 has a right-prism shaped central portion 24A which has three rectangular prism faces which are not visible and equilateral triangular shaped top and bottom prism bases of which only the top prism base is visible in the view of FIG. 3. Ferrite element 24 also has three triangular shaped arm portions 24B, 24C and 24D which extend radially outwardly from the prism faces of the central portion 24A. Each of the ferrite element arm portions has a downwardly sloping top surface 27B which extends from the top prism base of the ferrite element central portion 24A to the surface 23 of the second dielectric substrate 20. The bottom surface 27A of the ferrite element 24 is coplanar and abuts the surface 23 of the second dielectric substrate 20.

Ferrite element 25 is of identical construction to ferrite element 24 and has a central portion 25A and three arm portions 25B, 25C and 25D. Similarly, ferrite element 26 is of identical construction to the first two ferrite elements and has a central portion 26A and three arm portions 26B, 26C, and 26D. The three wye-shaped ferrite elements 24, 25 and 26 are tandem interconnected in a double-ended wye configuration because ferrite element 24 has only one "free" arm portion, namely, arm portion 24B, since its other two arm portions 24C and 24D are connected to an arm portion of the other two ferrite elements 25 and 26. Each of the ferrite elements 25 and 26, however, has two "free" arm portions since only one of their three arm portions is connected to another ferrite element. This arrangement may be thought of as a double-ended wye configuration.

Figure 3:
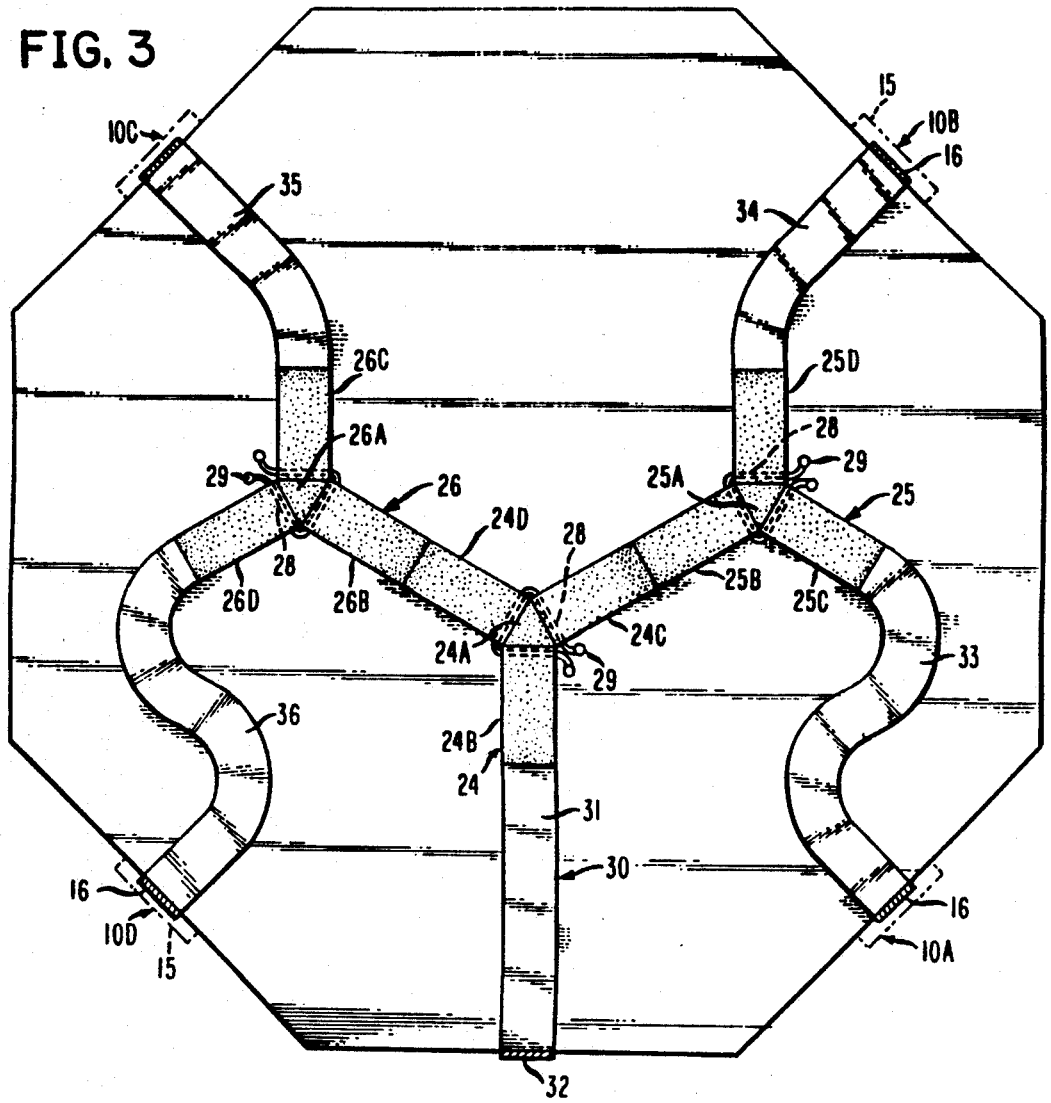
FIG. 3 is a top plan view of the selectively operable microstrip circulator means and dielectric substrate therefor which serves as a bottom cover to close off the other end of the electronic scan antenna array housing.
Figure 4:
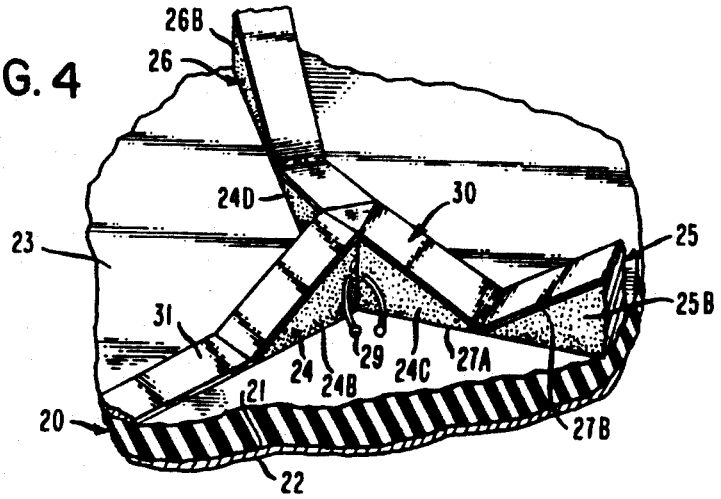
FIG. 4 is a perspective view of a fragmentary portion of the selectively operable microstrip circulator means shown in FIG. 3.

Each of the three ferrite elements 24, 25 and 26 is provided with selectively operable magnetic biasing means for applying a reversible direction d.c. magnetic field between the top and bottom prism bases of the ferrite element's central portion. This is accomplished by creating a laterally extending bore 28 passing through each of the three arm portions of each ferrite element as seen in FIGS. 3 and 4 of the drawings and by utilizing separately controllable control wire means 29 passing through the bores 28 of each ferrite element for carrying a d.c. control current through each of the bores in the same rotational direction about the longitudinal axis of the central portion of the ferrite element so that a resultant unidirectional magnetic field is established between the top and bottom prism basis of the central portion of the ferrite element. The longitudinal axis of the central portion 24A of ferrite element 24, for example, would be perpendicular to the top and bottom prism bases of the central element and would be normal to the plane of the paper in the view of FIG. 3. Accordingly, the rotational direction of the d.c. control current through each of the three bores 28 in ferrite element 24 should all be clockwise or counter clockwise about the longitudinal axis so that the resultant unidirectional magnetic field between the prism bases is maximized. The three ferrite elements 24, 25 and 26 may each be fabricated of a ferrite material, such as nickel zinc ferrite or lithium zinc ferrite, for example, which has a "square" hysteresis loop so that the magnetic direction of the resultant unidirectional magnetic field established in the central portion of each of the three ferrite elements may be latched from one state to the opposite state by the application of a single control current pulse to the control wire means for the ferrite element.

Second electrically conductive microstrip conductor means, indicated generally as 30, are disposed on the top prism bases of all three ferrite element central portions, the downwardly sloping top surfaces 27B of all of the arm portions of all of the three ferrite elements and on the surface 23 of the second dielectric substrate 20. Again, the second microstrip conductor means 30 should be fabricated of a good electrically conductive metal, such as copper or silver, for example. By virtue of the foregoing arrangement of substrate 20, ground plane 22 and the portion of the microstrip conductor means 30 which is mounted on the top surfaces of the three ferrite elements, each of the three wye-shaped ferrite elements 24, 25 and 26 acts as a separately switchable microstrip Y-junction circulator of the type shown and described in U.S. Pat. No. 4,754,237, issued to the inventors of the present application on Jun. 28, 1988 and assigned to the assignee of its present application, to which reference is made for further details of construction and operation. The second microstrip conductor means 30 has a portion 31 which is disposed on the surface 23 of dielectric substrate 20 for connecting the free arm portion 24B of ferrite element 24 to a small contact or projection 32 on the exterior of the octagonal housing of the antenna array of the invention so that the antenna array may be connected to a source (not shown) of millimeter wave energy. Additionally, the microstrip conductor means 30 has a portion 33 which connects the free arm portion 25C of ferrite element 25 to microstrip patch antenna array 10A, a portion 34 which connects free arm portion 25D of ferrite element 25 to microstrip patch antenna array 10B, a portion 35 which connects free arm portion 26C of ferrite element 26 to microstrip patch antenna array 10C and a portion 36 which couples free arm portion 26D of ferrite element 26 to microstrip patch antenna array 10D.

Figure 5:
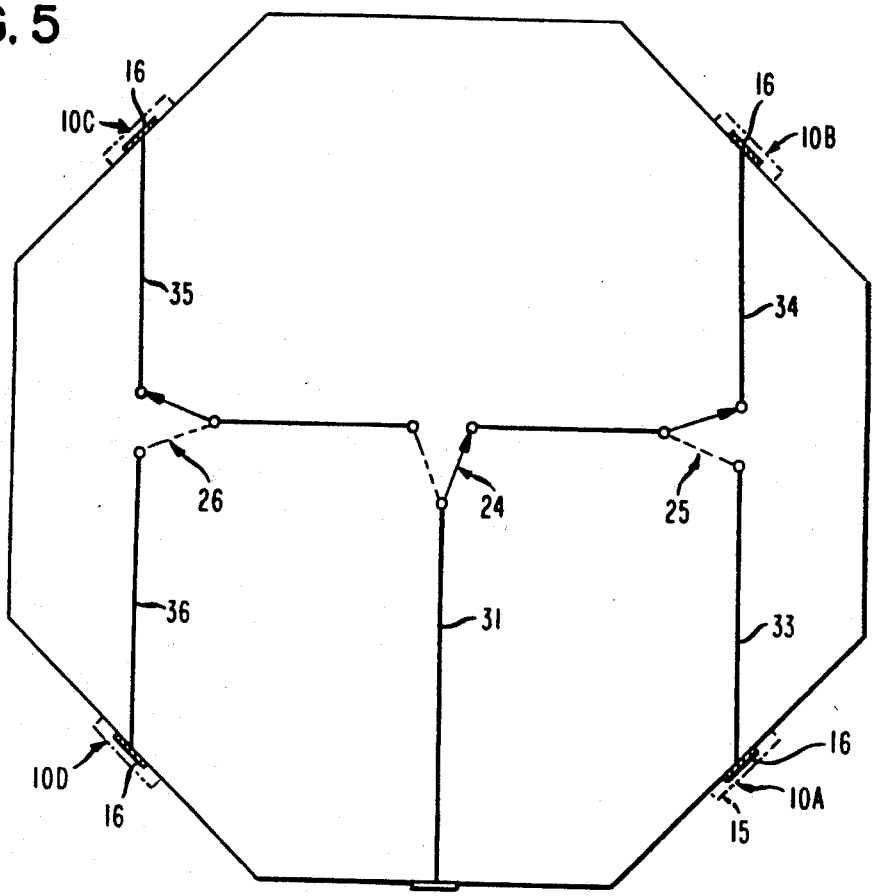
FIG. 5 is a schematic circuit diagram useful in explaining the basic operation of the microstrip electronic scan antenna array of the invention.

By virtue of the foregoing arrangement, any one of the four microstrip patch antenna arrays 10A through 10D may be separately connected for energization by a source of millimeter wave energy. This may be seen from an inspection of FIG. 5 of the drawings which is a schematic circuit diagram of the selectively operable microstrip circulator means shown in FIGS. 3 and 4. As seen in FIG. 5, each of the three microstrip circulators 24, 25 and 26 may be thought of as a single pole—double throw switch having a single input and two outputs. Each of the three circulators 24, 25 and 26 may be independently switched to either of its two outputs by operation of the control wire means 29 associated with that circulator which establishes the rotational direction of circulator coupling action for the circulator involved. For example, referring to FIG. 3 of the drawings, assuming that a counterclockwise scan is desired about the axis x—x axis in which the microstrip patch antenna arrays are energized in the sequence 10A, 10B, 10C and lastly 10D, the control wire means 29 associated with ferrite element 24 would be pulsed with a d.c. control current pulse of a polarity which would give that circulator a counterclockwise direction of circulator coupling action so that the millimeter wave energy supplied to arm portion 24B of ferrite element 24 would be passed on to arm portion 24C of that element and subsequently to arm portion 25B of the ferrite element 25. Similarly, the control wire 29 associated with the ferrite element 25 would be pulsed with a control current of a polarity which would give that circulator a counterclockwise direction of circulator coupling action so that the energy which is received by arm portion 25B is applied to arm portion 25C and thence by the microwave transmission line section 33 to microstrip patch antenna array 10A.

At this time, none of the other three patch antenna arrays will be energized. Ferrite element 24 will remain latched in the counterclockwise direction of circulator coupling action so that in order to energize microstrip patch antenna array 10B and to de-energize microstrip patch antenna array 10A it is only necessary to reverse the direction of circulator coupling action of the ferrite element 25 by passing a control current pulse of reverse polarity through the control wire 29 for that element. This will couple circulator arm portion 25B of ferrite element 25 to arm portion 25D and will permit the millimeter wave energy passing through arm portions 24B and 24C of ferrite element 24 to be applied to antenna array 10B by the microstrip portion 34. For the next switch, a control pulse of opposite polarity is applied to the control wire 29 of ferrite element 24 to give the circulator formed by that ferrite element a clockwise direction of circulator coupling action so that millimeter wave energy will be applied through the arm portion 24B to the arm portion 24D and thence to the arm portion 26B of ferrite element 26. Ferrite element 26 is then pulsed with a control current direction which would give it a counter clockwise direction of circulator coupling action so that arm portion 26C would receive the millimeter wave energy from arm portion 26B and apply it by the microstrip transmission line section 35 to microstrip patch antenna 10C. A reverse polarity current pulse is then applied to the control wire 29 for ferrite element 26 to reverse the direction of circulator coupling action and to apply the millimeter wave energy to the microstrip patch antenna 10D and to disconnect it from patch antenna 10C.

Thus, it is readily apparent that a series of pulses of predetermined polarities need only be applied to each of the control wires 29 to effect the desired antenna sweeping action. The antenna sweeping action may be readily reversed from one rotational direction about the X—X axis to the other by reversing the sequence or order of antenna energization. The antenna scanning rate would therefore depend upon the pulse repetition rate of the series of control pulses applied to the control wires 29.

Figure 6:
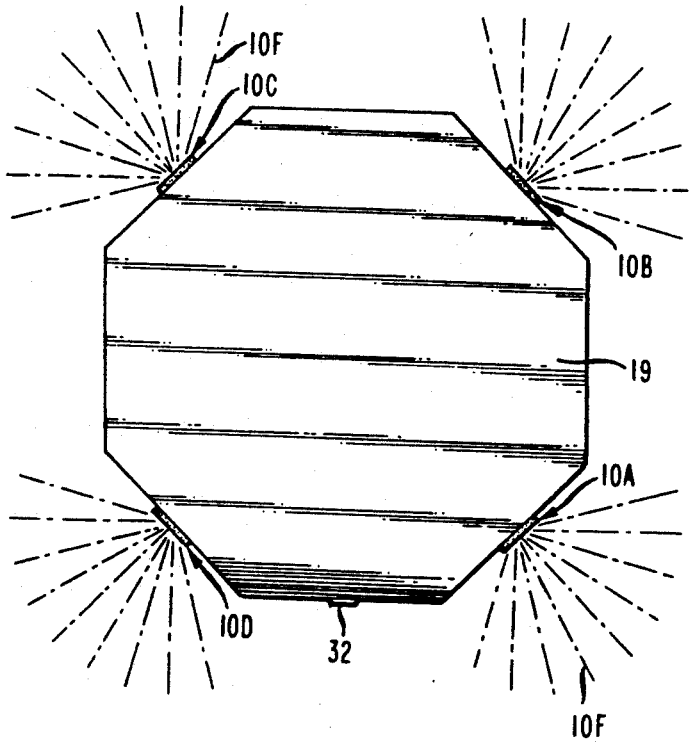
FIG. 6 is a top plan view of the microstrip electronic scan antenna array showing the beam patterns of the four microstrip patch antenna arrays.

The foregoing microstrip electronic scan antenna array provides an efficient, relatively low cost way of securing a full 360 degree electronic scanning action. Referring again to FIG. 1 of the drawings since the plurality of microstrip antenna radiating elements 15 for each of the four microstrip patch antenna arrays 10A through 10D are disposed in a single column which is substantially parallel to the central axis X—X, each of the four microstrip patch antenna arrays 10A through 10D will radiate a fixed discrete antenna beam which is substantially fan-shaped in a plane perpendicular to the central axis X—X as illustrated by the antenna beams 10F of FIG. 6 of the drawings. Each of these antenna beams may be made as narrow as desired in the orthogonally-related plane by increasing the number of microstrip antenna radiating elements 15 making up the column of each patch array.

It is believed apparent that many changes could be made in the construction and described uses of the foregoing microstrip electronic scan antenna array and many seemingly different embodiments of the invention could be constructed without departing from the scope thereof. For example, the number of wye-shaped ferrite elements and hence the number of circulators employed on the substrate 20 could be increased so that eight instead of four microstrip patch antennas could be fed. This would require the use of four additional wye-shaped ferrite elements. Accordingly, it is intended that all matter contained in the above description or shown in the accompanying drawings shall be interpreted as illustrative and not in a limiting sense.

What is claimed is:

1. A microstrip electronic scan antenna array comprising:

a plurality of microstrip patch antenna arrays disposed circumferentially about a central axis, each of said microstrip patch antenna arrays radiating a discrete antenna beam at a different selected bearing point about said axis when said array is coupled to a source of millimeter wave energy, said plurality of microstrip patch antenna arrays comprising four microstrip patch antenna arrays; and selectively operable microstrip circulator means coupled to said plurality of microstrip patch antenna arrays for sequentially coupling each of said plurality of microstrip patch antenna arrays to a source of millimeter wave energy, said selectively operable microstrip circulator means comprising a plurality of separately switchable microstrip Y-junction circulators tandem interconnected in double-ended wye configuration, each of said circulators having an input and two outputs and operating as single pole-double throw switch with respect to millimeter wave energy applied to the circulator input, said plurality of switchable microstrip Y-junction circulators comprising three switchable microstrip Y-junction circulators tandem interconnected in a double-ended wye configuration with one of said three circulators having the input thereof coupled to said source of millimeter wave energy and the two outputs thereof coupled to the inputs of the remaining two of said three circulators, said remaining two circulators having the outputs thereof each coupled to a different one of said four microstrip patch antenna arrays.

2. A microstrip electronic scan antenna array as claimed in claim 1 wherein said four microstrip patch antenna arrays are disposed at quadrantially related bearing points about said axis so that said microstrip electronic scan antenna array has a 360 degree scanning capability when said four microstrip patch antenna arrays are successively coupled to said source of millimeter wave energy in the order of their bearing points about said axis.

3. A microstrip electronic scan antenna array as claimed in claim 2 wherein each of said microstrip patch antenna arrays comprises a first microstrip transmission line dielectric substrate spaced laterally from and extending substantially parallel to said axis, said substrate having an inner surface facing said axis and an outer surface facing away from said axis, a first electrically conductive ground plane disposed on the inner surface of said substrate, a plurality of microstrip antenna radiating elements mounted on the outer surface of said substrate, and first electrically conductive microstrip conductor means disposed on the outer surface of said substrate and extending to one of the ends of said substrate for electrically interconnecting said plurality of microstrip antenna radiating elements.

4. A microstrip electronic scan antenna array as claimed in claim 3 wherein said plurality of switchable microstrip Y-junction circulators comprises a second microstrip transmission line dielectric substrate extending transverse said axis at said one ends of said first microstrip transmission line dielectric substrate, a second electrically conductive ground plane disposed on one surface of said second dielectric substrate, three wye-shaped ferrite elements tandem interconnected in a double-ended wye configuration and having a coplanar bottom surface, said three ferrite elements being mounted on the other surface of said second dielectric substrate with said bottom surface of said three ferrite elements abutting said second dielectric substrate other surface, each of said three ferrite elements having a right-prism shaped central portion with three rectangular prism faces and equilateral triangular shaped top and bottom prism bases, three triangular shaped arm portions extending radially outwardly from said central portion prism faces, each of said ferrite element arm portions having a downwardly sloping top surface which extends from the top prism base of said ferrite element central portion to said other surface of said second dielectric substrate, and selectively operable magnetic biasing means for applying a reversible direction d.c. magnetic field between the ferrite element central portion top and bottom prism bases, and second electrically conductive microstrip conductor means disposed on the top prism bases of said ferrite element central portions, the downwardly sloping top surfaces of the ferrite element arm portions and on said other surface of said second dielectric substrate for connecting the free arm portion of that one of said three ferrite elements which has its remaining two arm portions connected to an arm portion of the remaining two ferrite elements to said source of millimeter wave energy and each of the remaining free arm portions of said two remaining ferrite elements to said first electrically conductive microstrip conductor means interconnecting the plurality of microstrip radiating elements of a different one of said four microstrip patch antenna arrays so that said one ferrite element acts as said one microstrip circulator and said two remaining ferrite elements act as said remaining two circulators.

5. A microstrip electronic scan antenna array as claimed in claim 4 wherein said selectively operable biasing means comprises a laterally extending bore passing through each of the arm portions of each of said three ferrite wye-shaped elements, and separately controllable control wire means passing through the bores in the arm portions of each of said three ferrite wye-shaped elements for carrying a d.c. control current through each of said bores in the same rotational direction about the longitudinal axis of the central portion of the wye-shaped ferrite element so that a resultant unidirectional magnetic field is established between the top and bottom prism bases of the central portion of the wye-shaped element and the rotational direction of circulator coupling action of the switchable Y-junction microstrip circulator formed by that wye-shaped element can be separately switched by reversing the polarity of said d.c. control current.

6. A microstrip electronic scan antenna array as claimed in claim 5 wherein each of said three ferrite wye-shaped elements is fabricated of a ferrite material having a square hysteresis loop so that the magnetic direction of said resultant unidirectional magnetic field in each of the three ferrite elements may be latched from one state to the opposite state by the application of a control current pulse to the control wire means for each of said three ferrite elements.

7. A microstrip electronic scan antenna array as claimed in claim 6 further comprising four housing panels each spaced laterally from and extending substantially parallel to said central axis, each of said housing panels extending between a different adjacent pair of the first microstrip transmission line dielectric substrates forming said four microstrip patch antenna arrays so that a hollow elongated octagonal housing is formed about said central axis, an octagonal-shaped cover disposed substantially perpendicular to said central axis and extending between said four panels and said first dielectric substrates at the other ends of said first dielectric substrates, and wherein said second microstrip transmission line dielectric substrate is octagonal-shaped and is disposed substantially perpendicular to said central axis with said other surface of said second dielectric substrate facing the hollow interior of said octagonal housing so that said selectively operable microstrip circulator means are disposed within the closed interior of the electronic scan antenna array formed by said second dielectric substrate, said octagonal housing and said cover.

8. A microstrip electronic scan antenna array as claimed in claim 7 wherein said housing panels and said cover are fabricated of a microstrip transmission line dielectric substrate material.

9. A microstrip electronic scan antenna array as claimed in claim 8 wherein said plurality of microstrip antenna radiating elements forming each of said microstrip patch antenna arrays are disposed in a single column which is substantially parallel to said central axis, so that each of said microstrip patch antenna arrays radiates a fixed antenna beam which is substantially fan-shaped in a plane perpendicular to said central axis.

* * * * *